US006001795A

United States Patent [19]

Charlez et al.

[11] Patent Number: 6,001,795

[45] **Date of Patent: *Dec. 14, 1999**

[54] MICROEMULSION ALL PURPOSE LIQUID CLEANING COMPOSITIONS

[75] Inventors: Maria Jose Charlez, Fuentes del Pedregal; Abraham Cazes, Col. Polanco, both of Mexico

[73] Assignee: Colgate-Palmolive Co., Piscataway, N.J.

[ * ] Notice: This patent is subject to a terminal disclaimer.

[21] Appl. No.: 09/103,077

[22] Filed: Jun. 23, 1998

Related U.S. Application Data

[63] Continuation-in-part of application No. 08/870,327, Jun. 6, 1997.

[51] Int. Cl.[6] ..... C11D 1/22; C11D 3/50; C11D 9/02; C11D 3/43

[52] U.S. Cl. ..... 510/365; 510/238; 510/424; 510/437; 510/506

[58] Field of Search ..... 510/417, 365, 510/424, 238, 101, 506, 422, 429, 433, 503, 427, 245, 400, 434

[56] References Cited

U.S. PATENT DOCUMENTS

| | | | |
|---|---|---|---|
| 5,573,702 | 11/1996 | Bonnechere et al. | 510/417 |
| 5,587,357 | 12/1996 | Rhginesmith | 510/417 |
| 5,773,395 | 6/1998 | Charlez et al. | 510/101 |
| 5,851,976 | 12/1998 | Mertens | 510/365 |

*Primary Examiner*—Yogendra Gupta
*Assistant Examiner*—Gregory Webb
*Attorney, Agent, or Firm*—Richard E. Nanfeldt

[57] ABSTRACT

An improvement is described in the microemulsion compositions which is especially effective in the removal of oily and greasy soil contains an anionic detergent, a saturated fatty acid, an unsaturated fatty acid, a solubilizing agent, a perfume having a pine like odor, an alkali metal hydroxide and water.

12 Claims, No Drawings

MICROEMULSION ALL PURPOSE LIQUID CLEANING COMPOSITIONS

RELATED APPLICATION

This application is a continuation in part application of U.S. Ser. No. 08/870,327 filed Jun. 6, 1997.

FIELD OF THE INVENTION

This invention relates to an improved all-purpose liquid cleaner in the form of a microemulsion designed in particular for cleaning hard surfaces and which is effective in removing grease soil and/or bath soil and in leaving unrinsed surfaces with a shiny appearance.

BACKGROUND OF THE INVENTION

In recent years all-purpose liquid detergents have become widely accepted for cleaning hard surfaces, e.g., painted woodwork and panels, tiled walls, wash bowls, bathtubs, linoleum or tile floors, washable wall paper, etc. Such all-purpose liquids comprise clear and opaque aqueous mixtures of water-soluble synthetic organic detergents and water-soluble detergent builder salts. In order to achieve comparable cleaning efficiency with granular or powdered all-purpose cleaning compositions, use of water-soluble inorganic phosphate builder salts was favored in the prior art all-purpose liquids. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved all-purpose liquids containing reduced concentrations of inorganic phosphate builder salts or non-phosphate builder salts have appeared. A particularly useful self-opacified liquid of the latter type is described in U.S. Pat. No. 4,244,840.

However, these prior art all-purpose liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user.

In order to overcome the foregoing disadvantage of the prior art all-purpose liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free all-purpose liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or all-purpose liquid detergent composition where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 Å to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. No. 4,472,291—Rosario; U.S. Pat. No. 4,540,448—Gauteer et al; U.S. Pat. No. 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; 4,414,128; and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) lying in the range of 5:1 to 1:3; and (c) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

Furthermore, the present inventors have observed that in formulations containing grease-removal assisting magnesium compounds, the addition of minor amounts of builder salts, such as alkali metal polyphosphates, alkali metal carbonates, nitrilotriacetic acid salts, and so on, tends to make it more difficult to form stable microemulsion systems.

U.S. Pat. No. 5,082,584 discloses a microemulsion composition having an anionic surfactant, a cosurfactant, nonionic surfactant, perfume and water.

SUMMARY OF THE INVENTION

The present invention provides an improved, clear, liquid cleaning composition having improved interfacial tension which improves cleaning hard surface in the form of a microemulsion which is suitable for cleaning hard surfaces such as plastic, vitreous and metal surfaces having a shiny finish. More particularly, the improved cleaning compositions exhibit good grease soil removal properties due to the improved interfacial tensions, when used in undiluted (neat) form and leave the cleaned surfaces shiny without the need of or requiring only minimal additional rinsing or wiping. The latter characteristic is evidenced by little or no visible residues on the unrinsed cleaned surfaces and, accordingly, overcomes one of the disadvantages of prior art products. The instant compositions exhibit a blooming effect, when the composition is added to water in that the formed solution is cloudy.

In one aspect, the invention generally provides a stable, clear all-purpose, hard surface cleaning composition especially effective in the removal of oily and greasy oil, which is in the form of a substantially dilute oil-in-water microemulsion having an aqueous phase and an oil phase. The dilute o/w microemulsion includes, on a weight basis:

- from 0.25% to 7%, more preferably 0.5% to 5.0% of an anionic surfactant;
- from 0.1% to 10%, more preferably 0.5% to 7%, of a water-mixable cosurfactant having either limited ability or substantially no ability to dissolve oily or greasy soil;
- 0.5% to 10%, more preferably 0.75% to 7%, of an unsaturated fatty acid;
- 0.5% to 10%, more preferably 0.75% to 7%, of a fatty acid;
- 0.5% to 20.0%, more preferably 1% to 8% of a perfume having a pine like odor wherein 5 to 40 wt. % of the perfume is an eucalyptus oil;
- 0.1% to 8%, more preferably 0.5% to 6% of a solubilizing agent;
- 0.1% to 5%, more preferably 0.5% to 4.5% of an alkali metal hydroxide;
- 10% to 85% of water, wherein the composition does not contain pine oil.

DETAILED DESCRIPTION OF THE INVENTION

The present invention relates to a stable liquid crystal or microemulsion composition by weight: 0.25% to 7% of an anionic surfactant, 0.1% to 5% of an alkali metal hydroxide, 0.1% to 10% of a cosurfactant, 0.5% to 20% of a perfume having a pine like odor, wherein the perfume contains 5 to 40 wt. % of an eucalyptus oil, insoluble hydrocarbon, 0.1% to 8% of a solubilizing agent, 0.5% to 10% of a saturated fatty acid; 0.5% to 10% of an unsaturated fatty acid and the balance being water.

The instant compositions do not contain a grease release agent such as choline chloride or a polymer depicted by the formula:

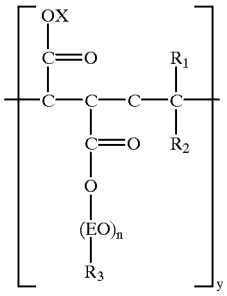

wherein x is a hydrogen or an alkali metal cation such as potassium or sodium and n is a number from 2 to 16, preferably 2 to 10, $R_1$ is selected from the group consisting of methyl or hydrogen, $R_2$ is a $C_1$ to $C_{12}$ preferably $C_4$ to $C_8$, linear or branched chained alkyl group and $R_3$ is a $C_2$ to $C_{16}$, preferably $C_2$ to $C_{12}$ linear or branched chained alkyl group and y is of such a value as to provide a molecular weight of about 5,000 to about 15,000.

The instant compositions do not contain a nonionic surfactant containing ethoxylated groups.

The perfume which is employed in the instant composition has a pine like odor and contains 5 to 40 wt. %, more preferably 10 to 25 wt. % of an eucalyptus oil and 1 to 20 wt. %, more preferably 3 to 15 wt. % of limonene. The perfume is present in the composition at a concentration of 0.5 to 20 wt. %, more preferably 1 to 8 wt. %.

The water-soluble organic surfactant materials which are used in forming the ultimate o/w microemulsion compositions of this invention are water-soluble, non-soap, anionic surfactants.

Regarding the anionic surfactant present in the o/w microemulsions any of the conventionally used water-soluble anionic surfactants or mixtures of said anionic detergents and anionic detergents can be used in this invention. As used herein the term "anionic surfactant" is intended to refer to the class of anionic and mixed anionic-nonionic surfactants providing detersive action.

Suitable water-soluble non-soap, anionic surlactants include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble surfactant. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_{2-C3}$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735, 096.

Examples of satisfactory anionic sulfate surfactants are the $C_8$–$C_{18}$ alkyl sulfate salts and the $C_8$–$C_{18}$ alkyl sulfate salts and the $C_8$–$C_{18}$ alkyl ether polyethenoxy sulfate salts having the formula $R(OC_2H_4)_n\ OSO_3M$ wherein n is 1 to 12, preferably 1 to 5, and M is a solubilizing cation selected from the group consisting of sodium, potassium, ammonium, magnesium and mono-, di- and triethanol ammonium ions. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These detergents can be prepared by reacting an alkyl phenol with 2 to 6 moles of ethylene oxide and sulfating and neutralizing the resultant ethoxylated alkylphenol.

Obviously, these anionic surfactants will be present either in acid form or salt form depending upon the pH of the final composition, with salt forming cation being the same as for the other anionic detergents.

Of the foregoing non-soap anionic surfactants, the preferred surfactants are the $C_9$–$C_{15}$ linear alkylbenzene sulfonates. Particularly, preferred compounds are the sodium salts $C_{10}$–$C_{13}$ alkylbenzene sulfonate such as sodium dodecyl benzene sulfonate.

Generally, the proportion of the nonsoap-anionic surfactant will be in the range of 0.25% to 7%, preferably from 0.5% to 5%, by weight of the dilute o/w microemulsion composition.

The preferred long chain saturated fatty acids are the higher saturated aliphatic fatty acids having from 8 to 22 carbon atoms, more preferably from 10 to 20 carbon atoms, and especially preferably from 12 to 18 carbon atoms, and especially preferably from 12 to 18 carbon atoms, inclusive of the carbon atom of the carboxyl group of the fatty acid. The aliphatic radical may be saturated or unsaturated and may be straight or branched. Straight chain saturated fatty acids are preferred. Stearic acid and mixed fatty acids, e.g. stearic acid/palmitic acid, are preferred. The mixture of the saturated fatty acid such as stearic acid with the unsaturated fatty acid such as coconut fatty acids helps to improve the blooming effect, when the final product is poured in the water to form the cleaning solution.

When the free acid form of the saturated fatty acid is used directly it will generally associate with the potassium and sodium ions in the aqueous phase to form the corresponding alkali metal fatty acid soap. However, the saturated fatty acid salts may be directly added to the composition as sodium salt or potassium salt, or as a polyvalent metal salt, although the alkali metal salts of the saturated fatty acids are preferred saturated fatty acid salts.

The preferred polyvalent metals are the di- and tri-valent metals of Groups IIA, IIB and IIIB, such as magnesium, calcium, aluminum and zinc, although other polyvalent metals, including those of Groups IIIA, IVA, VA, IB, IVB, VB VIB, VIIB and VIII of the Periodic Table of the Elements can also be used. Specific examples of such other polyvalent metals include Ti, Zr, V, Nb, Mn, Fe, Co, Ni, Cd, Sn, Sb, Bi, etc. Generally, the metals may be present in the divalent to pentavalent state. Preferably the metal salts are used in their higher oxidation states. Naturally, for use in automatic dishwashers, as well as any other applications where the invention composition will or may come in contact with articles used for the handling, storage or serving of food products or which otherwise may come into contact with or be consumed by people or animals, the metal salt should be selected by taking into consideration the toxicity of the metal. For this purpose, the alkali metal and calcium and magnesium salts are especially higher preferred as generally safe food additives.

Generally, however, amounts of the saturated fatty acid or saturated fatty acid salt is in the range of from 0.5 to 10 wt. %, more preferably 0.75 to 7 wt. %.

The preferred long chain unsaturated fatty acids of the instant invention have 8 to 24 carbon atoms, more preferably 10 to 20 carbon atoms. A preferred unsaturated fatty acid mixture is a refined tall oil fatty acid. A typical tall oil fatty acid contains mono unsaturated $C_{16-18}$ fatty acid; a $C_{18}$ diene unsaturated fatty acid; a $C_{16-18}$ triene unsaturated fatty acid; and a $C_{16-18}$ saturated fatty acid. Other unsaturated fatty acids that are usable in the instant compositions are unsaturated vegetable oil fatty acids, including soy, peanut, corn, cottonseed, linseed and refined oleic fatty acids, and fatty acids consisting predominantly of $C_{18}$ (average) unsaturated fatty acids and mixtures thereof. The unsaturated fatty acid reacts in situ with the alkali metal hydroxide to form the alkali metal salt of the unsaturated fatty acid. The concentration of the unsaturated fatty acid is 0.5 to 10 wt %, more preferably 0.75 to 7 wt %. The alkali metal hydroxide present in the composition is preferably potassium hydroxide and is present in the composition at a concentration of 0.1 to 5 wt %, more preferably 0.5 to 4.5 wt %. The potassium hydroxide reacts in situ with both the saturated and unsaturated fatty acid in the composition to form the potassium salts of the saturated fatty acid. The concentration of the saturated fatty acid and the unsaturated fatty acid taken together is at least 3 wt. %, more preferably at least 3.5 wt. %.

The solubilizing agents are water soluble hydrotropic salts of xylene or cumene sulfonate include sodium, potassium, ammonium and mono-, di- and triethanolammonium salts of xylene or cumene sulfonate or $C_2$–$C_4$ alkanols or dealkanols such as isopropanol. While the aqueous medium is primarily water, preferably said solubilizing agents are included in order to control the viscosity of the liquid composition and to control low temperature cloud clear properties. Usually, it is desirable to maintain clarity to a temperature in the range of 5° C. to 10° C. Therefore, the proportion of solubilizer generally will be from 1%–15%, preferably 2%–12%, most preferably 2%–8%, by weight of the detergent composition with the proportion of ethanol, when present, being 5% of weight or less in order to provide a composition having a flash point above 46° C. The solubilizing ingredient can be a mixture of isopropanol or ethanol and either sodium xylene sulfonate or sodium cumene sulfonate or a mixture of said sulfonates or ethanol or isopropanol and urea.

The instant compositions contain 0.1 wt. % to 8 wt. %, more preferably 0.5 wt. % to 6 wt. %, of at least one solubilizing agent which is a $C_{2-5}$ mono, dihydroxy or polyhydroxy alkanols such as ethanol, isopropanol, glycerol ethylene glycol, diethylene glycol and propylene glycol and mixtures thereof. The solubilizing agents are included in order to control low temperature cloud clear properties. Urea can be optionally employed in the instant composition as a supplemental solubilizing agent at a concentration of 0 to 10 wt. %, more preferably 0.5 wt. % to 8 wt. %.

The cosurfactant may play an essential role in the formation of the microemulsion. Very briefly, in the absence of the cosurfactant the water, detergent(s) and hydrocarbon (e.g., perfume) will, when mixed in appropriate proportions form either a micellar solution (low concentration) or form an oil-in-water emulsion in the first aspect of the invention. With the cosurfactant added to this system, the interfacial tension at the interface between the emulsion droplets and aqueous phase is reduced to a very low value. This reduction of the interfacial tension results in spontaneous break-up of the emulsion droplets to consecutively smaller aggregates until the state of a transparent colloidal sized emulsion. e.g., a microemulsion, is formed. In the state of a microemulsion, thermodynamic factors come into balance with varying degrees of stability related to the total free energy of the microemulsion. Some of the thermodynamic factors involved in determining the total free energy of the system are (1) particle-particle potential; (2) interfacial tension or free energy (stretching and bending); (3) droplet dispersion entropy; and (4) chemical potential changes upon formation. A thermodynamically stable system is achieved when (2) interfacial tension or free energy is minimized and (3) droplet dispersion entropy is maximized.

Thus, the role of cosurfactant in formation of a stable o/w microemulsion is to (a) decrease interfacial tension (2); and (b) modify the microemulsion structure and increase the number of possible configurations (3). Also, the cosurfactant will (c) decrease the rigidity. Generally, an increase in cosurfactant concentration results in a wider temperature range of the stability of the product.

The major class of compounds found to provide highly suitable cosurfactants for the microemulsion over temperature ranges extending from 5° C. to 43° C. for instance are water-soluble polyethylene glycols having a molecular weight of 150 to 1000, polypropylene glycol of the formula $HO(CH_3CHCH_2O)_nH$ wherein n is a number from 2 to 18, mixtures of polyethylene glycol and polypropylene glycol (Synalox) and mono and di $C_1$–$C_6$ alkyl ethers and esters of ethylene glycol and propylene glycol having the structural formulas $R(X)_nOH$, $R_1(X)_nOH$, $R(X)_nOR$ and $R_1(X)_nOR_1$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4, diethylene glycol, triethylene glycol, an alkyl lactate, wherein the alkyl group has 1 to 6 carbon atoms, 1 methoxy-2-propanol, 1 methoxy-3-propanol, and 1 methoxy 2-, 3- or 4-butanol.

Representative members of the polypropylene glycol include dipropylene glycol and polypropylene glycol having a molecular weight of 150 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate. These glycol type cosurfactants are at a concentartion of 0.1 to 10 weight %, more preferably 0.5 weight % to 7 weight %.

While all of the aforementioned glycol ether compounds provide the described stability, the most preferred cosurfactant compounds of each type, on the basis of cost and cosmetic appearance (particularly odor), are dipropylene glycol monomethyl ether and diethylene glycol monobutyl ether. Other suitable water soluble cosurfactants are water soluble esters such as ethyl lactate and water soluble carbohydrates such as butyl glycosides.

The amount of cosurfactant required to stabilize the microemulsion compositions will, of course, depend on such factors as the surface tension characteristics of the cosurfactant, the type and amounts of the primary surfactants and water insoluble hydrocarbon, and the type and amounts of any other additional ingredients which may be present in the composition and which have an influence on the thermodynamic factors enumerated above. Generally, amounts of cosurfactant in the range of from 0.1% to 10%, preferably from 0.5 wt. % to 7 wt. % provide stable dilute o/w microemulsions for the above-described levels of primary surfactants and water insoluble hydrocarbon and any other additional ingredients as described below.

The combination of solubilizing agents and cosurfactants such as isopropanol and diethylene glycol monobutyl ether and perfume which has a pine like odor which are used in the invention tend to compatibilize the water insoluble within the aqueous dispersion such that clear stable dispersions are formed which will not separate or cloud up after period of standing. Also the solvents appear to act synergistically such that lesser amounts of the combination is required to achieve a stable dispersion than would be the case, if each type of solvent was used alone as the sole solvent source. This phenomena allows for a significantly lower VOC content in the composition which is more enviromentally preferred. The isopropanol and diethylenglycol monobutyl ether may be mixed at a respective weight ratio of from 1:2 to 2:1, more preferably at a ratio of 0.75:1 to 1.25:1 and most preferably at a ratio of 0.8:1 to 1:1 of alcohol and glycol ether respectively. A preferred solvent combination is isopropanol and diethylenglycol monobutyl ether.

The final essential ingredient in the inventive microemulsion compositions having improved interfacial tension properties is water. The proportion of water in the microemulsion compositions generally is in the range of 20% to 97%, preferably 70% to 97% by weight of the usual diluted o/w microemulsion composition.

In addition to the above-described essential ingredients required for the formation of the liquid crystal composition or the microemulsion composition, the compositions of this invention may often and preferably do contain one or more additional ingredients which serve to improve overall product performance.

One such ingredient is an inorganic or organic salt of oxide of a multivalent metal cation, particularly $Mg^{++}$. The metal salt or oxide provides several benefits including improved cleaning performance in dilute usage, particularly in soft water areas, and minimized amounts of perfume required to obtain the microemulsion state. Magnesium sulfate, either anhydrous or hydrated (e.g., heptahydrate), is especially preferred as the magnesium salt. Good results also have been obtained with magnesium oxide, magnesium chloride, magnesium acetate, magnesium propionate and magnesium hydroxide. These magnesium salts can be used with formulations at neutral or acidic pH since magnesium hydroxide will not precipitate at these pH levels.

Although magnesium is the preferred multivalent metal from which the salts (inclusive of the oxide and hydroxide) are formed, other polyvalent metal ions also can be used provided that their salts are nontoxic and are soluble in the aqueous phase of the system at the desired pH level. Thus, depending on such factors as the pH of the system, the nature of the primary surfactants and cosurfactant, and so on, as well as the availability and cost factors, other suitable polyvalent metal ions include aluminum, copper, nickel, iron, calcium, etc. It should be noted, for example, that with the preferred paraffin sulfonate anionic detergent calcium salts will precipitate and should not be used. It has also been found that the aluminum salts work best at pH below 5 or when a low level, for example 1 weight percent, of citric acid is added to the composition which is designed to have a neutral pH. Alternatively, the aluminum salt can be directly added as the citrate in such case. As the salt, the same general classes of anions as mentioned for the magnesium salts can be used, such as halide (e.g., bromide, chloride), sulfate, nitrate, hydroxide, oxide, acetate, propionate, etc.

Preferably, in the dilute compositions the metal compound is added to the composition in an amount sufficient to provide at least a stoichiometric equivalence between the anionic surfactant and the multivalent metal cation. For example, for each gram-ion of $Mg^{++}$ there will be 2 gram moles of paraffin sulfonate, alkylbenzene sulfonate, etc., while for each gram-ion of $A1^{3+}$ there will be 3 gram moles of anionic surfactant. Thus, the proportion of the multivalent salt generally will be selected so that one equivalent of compound will neutralize from 0.1 to 1.5 equivalents, preferably 0.9 to 1.4 equivalents, of the acid form of the anionic surfactant.

At higher concentrations of anionic surfactant, the amount of multivalent salt will be in range of 0.5 to 1 equivalents per equivalent of anionic surfactant.

The all-purpose liquid cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl-4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added.

The instant compositions of the instant invention explicitly exclude zwitterionic surfactant such as betaines because these zwitterionic surfactants are extremely high foaming which, if used in the instant composition, would cause the instant compositions to have to high a foam profile and that too much foam would leave residue on the surface being cleaned.

In final form, the all-purpose liquids are low foaming, clear oil-in-water microemulsions or liquid crystal compositions and exhibit stability at reduced and increased temperatures. More specifically, such compositions remain clear and stable in the range of 5° C. to 50° C., especially 10° C. to 43° C. Such compositions exhibit a pH in the acid or neutral range depending on intended end use. The liquid microemulsion compositions are readily pourable and exhibit a viscosity in the range of 6 to 60 milliPascal. second (mPas.) as measured at 25° C. with a Brookfield RVT Viscometer using a #1 spindle rotating at 20 RPM. Preferably, the viscosity is maintained in the range of 10 to 40 mPas.

The instant compositions have a pH of about 10 to about 14, more preferably about 11 to about 13, and most preferably about 12 to about 13.

The compositions are directly ready for use or can be diluted as desired and in either case no or only minimal rinsing is required and substantially no residue or streaks are left behind. Furthermore, because the compositions are free of detergent builders such as alkali metal polyphosphates they are environmentally acceptable and provide a better "shine" on cleaned hard surfaces.

When intended for use in the neat form, the liquid compositions can be packaged under pressure in an aerosol container or in a pump-type sprayer for the so-called spray-and-wipe type of application.

Because the compositions as prepared are aqueous liquid formulations and since no particular mixing is required to form the o/w microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary detergents and cosurfactants can be separately prepared and combined with each other and with the perfume. It was seen that making a premix of the solubilizing agent, cosurfactant and perfume (isopropanol, diethylene glycol monobutyl ether and fragrance) considerably reduces the mixing time, helping to achieve the emulsion, and could help in reducing the amount of solubilizer and/or cosurfactant needed in order to have a clear stable product. The magnesium salt, or other multivalent metal compound, when present, can be added as an aqueous solution thereof or can be added directly. It is not necessary to use elevated temperatures in the formation step and room temperature is sufficient.

The instant microemulsion formulas explicitly exclude alkali metal silicates and alkali meta builders such as alkali metal polyphosphates, alkali metal carbonates, alkali metal phosphonates and alkali metal citrates because these materials, if used in the instant composition, would cause the composition to have a high pH as well as leaving residue on the surface being cleaned.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared:

| | A | B | C | D | E | F | G | H |
|---|---|---|---|---|---|---|---|---|
| Sodium dodecyl benzene sulfonate $C_{13}$–$C_{17}$ sulfonate (48% A.I) | 2.17 | 2.17 | 2.17 | 2.17 | 2.17 | 2.17 | 2.17 | 2.17 |
| Stearic acid | 2.0 | 0.0 | 0.0 | 0.0 | 0.0 | 2.0 | 2.0 | 0 |
| Coconut fatty acid | 2.3 | 4.3 | 4.3 | 4.3 | 4.3 | 2.3 | 2.3 | 9.6 |
| Isopropanol | 2.0 | 2.0 | 2.0 | 0.0 | 2.5 | 2.0 | 4.5 | 2.0 |
| Diethylene glycol monobutyl ether | 2.5 | 2.5 | 2 | 4.5 | 2 | 2.5 | 0 | 2.5 |
| Potassium hydroxide | 2.7 | 2.7 | 2.7 | 2.7 | 2.7 | 2.7 | 2.7 | 5.8 |
| Perfume (a) | 5.0 | 10 | 10 | 10 | 10 | 10 | 10 | 20 |
| Water | Bal. | Bal | Bal | Bal | Bal | Bal | Bal | Bal |
| pH | 12 | 12–13 | uns | uns | 12–13 | 12–13 | uns | 12–13 |
| Degreasing test | | | | | | | | |
| Neat (b) | 10 | 9 | — | — | 12 | 9 | — | 6 |
| Dilute (b) | 28 | 27 | — | — | 32 | 28 | — | 22 |
| Residue | STD | EQ | | | EQ | EQ | | EQ |
| Foam in hard Water | STD | EQ | | | EQ | EQ | | EQ |
| Cloud point ($LC_i$) | >8 | >8 | | | 12 | >8 | | >8 |

*uns = Unstable dispersion, separated or clouded immediately or on standing up to 1 day (a) contains 5 to 15 wt. % of limonene and 12 to 22 wt. % of eucalyptus oil and the perfume has a pine like odor.

(b) the lower the number of strokes, the better the degreasing performance.

What is claimed is:

1. A microemulsion composition comprising:

(a) 0.25 wt. % to 7 wt. % of an anionic surfactant;

(b) 0.1 wt. % to 10 wt. % of a glycol ether cosurfactant;

(c) 0.5 wt. % to 20 wt. % of a perfume having a pine like odor and said perfume containing 5 wt. % to 40 wt. % of an eucalyptus oil;

(d) 0.5 wt. % to 10 wt. % of an unsaturated fatty acid;

(e) 0.5 wt. % to 10 wt. % of a saturated fatty acid;

(f) 0.1 wt. % to 5 wt. % of an alkali metal hydroxide;

(g) 0.1 wt. % to 8 wt. % of a solubilizing agent; and (h) the balance being water, wherein the compositions does not contain a grease release agent selected from the group consisting of choline chloride and a polymer depicted by the formula:

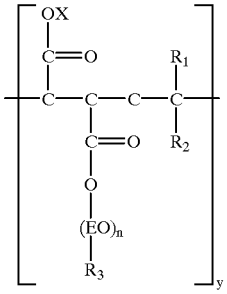

wherein x is a hydrogen or an alkali metal cation such as potassium or sodium and n is a number from 2 to 16, $R_1$ is selected from the group consisting of methyl or hydrogen, $R_2$ is a $C_1$ to $C_{12}$, linear or branched chained alkyl group and $R_3$ is a $C_2$ to $C_{16}$, linear or branched chained alkyl group and y is of such a value as to provide a molecular weight of about 5,000 to about 15,000.

2. The cleaning composition of claim 1 which further contains a salt of a multivalent metal cation in an amount sufficient to provide from 0.5 to 1.5 equivalents of said cation per equivalent of said anionic surfactant.

3. The cleaning composition of claim 2 wherein the multivalent metal cation is magnesium or aluminum.

4. The cleaning composition of claim 2, wherein said composition contains 0.9 to 1.4 equivalents of said cation per equivalent of anionic surfactant.

5. The cleaning composition of claim 2, wherein said multivalent salt is magnesium oxide, magnesium chloride or magnesium sulfate.

6. The cleaning composition of claim 1 wherein said saturated fatty acid has 8 to 22 carbon atoms.

7. The cleaning composition of claim 1 wherein said unsaturated fatty acid has 8 to 24 carbon atoms.

8. The cleaning composition of claim 1, wherein the cosurfactant is selected from the group consisting of ethylene glycol monobutyl ether, diethylene glycol monobutyl ether, triethylene glycol monobutyl ether, and propylene glycol tertiary butyl ether, mono, di, trip propylene glycol monobutyl ether.

9. The cleaning composition of claim 8 wherein the glycol ether is ethylene glycol monobutyl ether or diethylene glycol monobutyl ether.

10. The cleaning composition of claim 1 wherein said solubilizing agent is a C2–C4 alkanol.

11. The cleaning composition of claim 1 wherein the anionic surfactant is a $C_9$–$C_{15}$ alkyl benzene sulfonate.

12. The cleaning composition of claim 1, wherein said alkali metal hydroxide is potassium hydroxide.

* * * * *